US008510969B2

(12) United States Patent
Luo

(10) Patent No.: US 8,510,969 B2
(45) Date of Patent: Aug. 20, 2013

(54) FOOTWEAR WITH HEATING ARRANGEMENT

(76) Inventor: Danxia Luo, Guangdong (CN)

( * ) Notice: Subject to any disclaimer, the term of this patent is extended or adjusted under 35 U.S.C. 154(b) by 513 days.

(21) Appl. No.: 12/736,510

(22) PCT Filed: Aug. 28, 2009

(86) PCT No.: PCT/CN2009/073592

§ 371 (c)(1),
(2), (4) Date: Dec. 6, 2010

(87) PCT Pub. No.: WO2010/105463

PCT Pub. Date: Sep. 23, 2010

(65) Prior Publication Data

US 2011/0083339 A1 Apr. 14, 2011

(30) Foreign Application Priority Data

Mar. 19, 2009 (CN) ..... 2009 2 0136009 U

(51) Int. Cl.
*A43B 7/02* (2006.01)

(52) U.S. Cl.
USPC ..... 36/2.6; 219/211

(58) Field of Classification Search
USPC ..... 36/2.6, 43; 219/211
See application file for complete search history.

(56) References Cited

U.S. PATENT DOCUMENTS

| | | | | |
|---|---|---|---|---|
| 5,495,682 | A * | 3/1996 | Chen | 36/2.6 |
| 5,722,185 | A * | 3/1998 | Vigneron | 36/2.6 |
| 5,956,866 | A * | 9/1999 | Spears | 36/2.6 |
| 8,074,373 | B2 * | 12/2011 | Macher et al. | 36/2.6 |
| 2008/0083721 | A1 * | 4/2008 | Kaiserman et al. | 219/211 |
| 2010/0192406 | A1 * | 8/2010 | Au | 36/2.6 |
| 2011/0083339 | A1 * | 4/2011 | Luo | 36/2.6 |
| 2012/0005919 | A1 * | 1/2012 | Chen | 36/2.6 |

* cited by examiner

*Primary Examiner* — Ted Kavanaugh
(74) *Attorney, Agent, or Firm* — Novoclaims Patent Services, LLC; Mei Lin Wong

(57) ABSTRACT

A footwear which includes a footwear sole, a footwear vamp, and a heating arrangement, wherein the heating arrangement includes a rechargeable battery, a control circuitry, a heater element, a heater switch, and a recharging inlet, wherein the control circuitry includes a switching circuitry and a status indicator circuitry electrically connected with the switching circuitry, a control outlet, an intelligence control circuitry electrically connected with the switching circuitry, a thermistor, and a power control circuitry electrically connected with the control outlet. The power control circuitry includes a voltage maintenance circuitry, wherein the intelligence control circuitry is electrically connected with the thermistor. The heater element is electrically connected with the control circuitry, and is controlled by the control circuitry to selectively generate heat for maintaining a predetermined temperature at the footwear sole.

9 Claims, 4 Drawing Sheets

FOOTWEAR WITH HEATING ARRANGEMENT

BACKGROUND OF THE PRESENT INVENTION

1. Field of Invention

The present invention relates to footwear, and more particularly to footwear comprising a heating arrangement which is capable of providing continuous heating to the footwear for an extended period of time.

2. Description of Related Arts

Conventional footwear, such as a conventional shoe, usually comprises a sole a vamp, and a heater unit received in the sole. The heater unit usually comprises a rechargeable battery and a heating element connected to the rechargeable battery to generate heat for maintaining the sole at a predetermined temperature.

This kind of conventional footwear has a number of disadvantages mentioned below.

First, since the sole of the conventional shoe has limited space, the size of the rechargeable battery which can be received in the sole is therefore also limited. Thus, the rechargeable battery has merely limited capacity and needs recharging very frequently. When the heater unit is out of battery while the wearer is away from recharging facility, the shoe, even if equipped with the heater unit, is identical to traditional shoe and cannot maintain the predetermined temperature on the sole. In other words, conventional heater units for footwear can only work for a very limited period of time.

Second, the conventional shoe mentioned above can only be recharged through a recharging inlet which is usually located at either side of the vamp or the outsole of the shoe, the recharging inlet is likely to be in contact with dirt, dusts or even liquid when the shoe is worn by the user who engages in outdoor or even indoor activities. This may damage the recharging inlet and therefore undesirably prevent the heater unit from being properly recharged.

SUMMARY OF THE PRESENT INVENTION

The invention is advantageous in that it provides footwear comprising a heating arrangement which is capable of providing continuous heating to the footwear for an extended period of time.

Another advantage of the invention is to provide footwear, comprising a footwear sole; a footwear vamp provided on top of said footwear sole; and a heating arrangement, which comprises a rechargeable battery; a control circuitry comprising a switching circuitry and a status indicator circuitry electrically connected with said switching circuitry, a control outlet, an intelligence control circuitry electrically connected with said switching circuitry, a thermistor, and a power control circuitry electrically connected with said control outlet, and comprises a voltage maintenance circuitry, wherein said intelligence control circuitry is electrically connected with said thermistor; a heater element electrically connected with said control circuitry; a heater switch; and a recharging inlet, wherein said heater element is controlled by said control circuitry to selectively generate heat for maintaining a predetermined temperature at said footwear sole.

The heater element mentioned above comprises an infrared heating unit provided on the sole of the footwear for generating heat in the vicinity of Yongquan acupuncture point of the wearer. The intelligence control circuitry comprises an infrared control circuitry.

The infrared heating unit as mentioned above comprises an infrared filament which comprises carbon or tungsten wire, or any other kinds of heating films.

The footwear sole of the footwear mentioned above further comprises an insole, wherein the heater element is received underneath the insole.

The footwear sole of the footwear mentioned above further comprises an outsole, wherein the heater switch and the recharging inlet are provided on the outsole.

The footwear mentioned above further comprises a switch comprising a back panel, a front panel operatively coupled with the back panel, and a switch member provided on the front panel, wherein a recharging inlet is provided on the front panel. The front panel and the back panel are alignedly attached on an outer side and an inner side of the vamp respectively.

The footwear mentioned above further comprises a protective cover 2 movably mounted on the front panel.

The footwear mentioned above further comprises a protective member supported by the front panel and aligned with the switch member for protecting the switch member.

In accordance with another aspect of the invention, the present invention provides the following advantageous effects.

First, the heater element of the present invention is arranged to heat up the footwear sole in a rapid manner when the temperature of the footwear sole falls below a certain predetermined temperature. Moreover, when the temperature of the footwear sole is above a certain predetermined threshold, the intelligence control circuitry and the voltage maintenance circuitry are arranged to deactivate the heater element so as to stop heating the footwear sole. Furthermore, the voltage maintenance circuitry enhances the voltage for heating up the footwear sole in such a manner that the electrical capacity of the rechargeable battery can be completely used up for providing energy to the heater element. This strategy minimizes the frequency of recharging the rechargeable battery on the part of the user of the present invention. According to carefully controlled experiment, a fully recharged rechargeable battery may be used for activating the heater element to maintain the footwear sole at a predetermined temperature for a whole day without recharging.

Second, the heater element utilized by the present invention involves infrared radiation which will stimulate the Yongquan acupuncture point of the wearer and perform certain therapeutic purposes. This cannot be done by conventional footwear.

DETAILED DESCRIPTION OF THE PREFERRED EMBODIMENT

Figure 1:
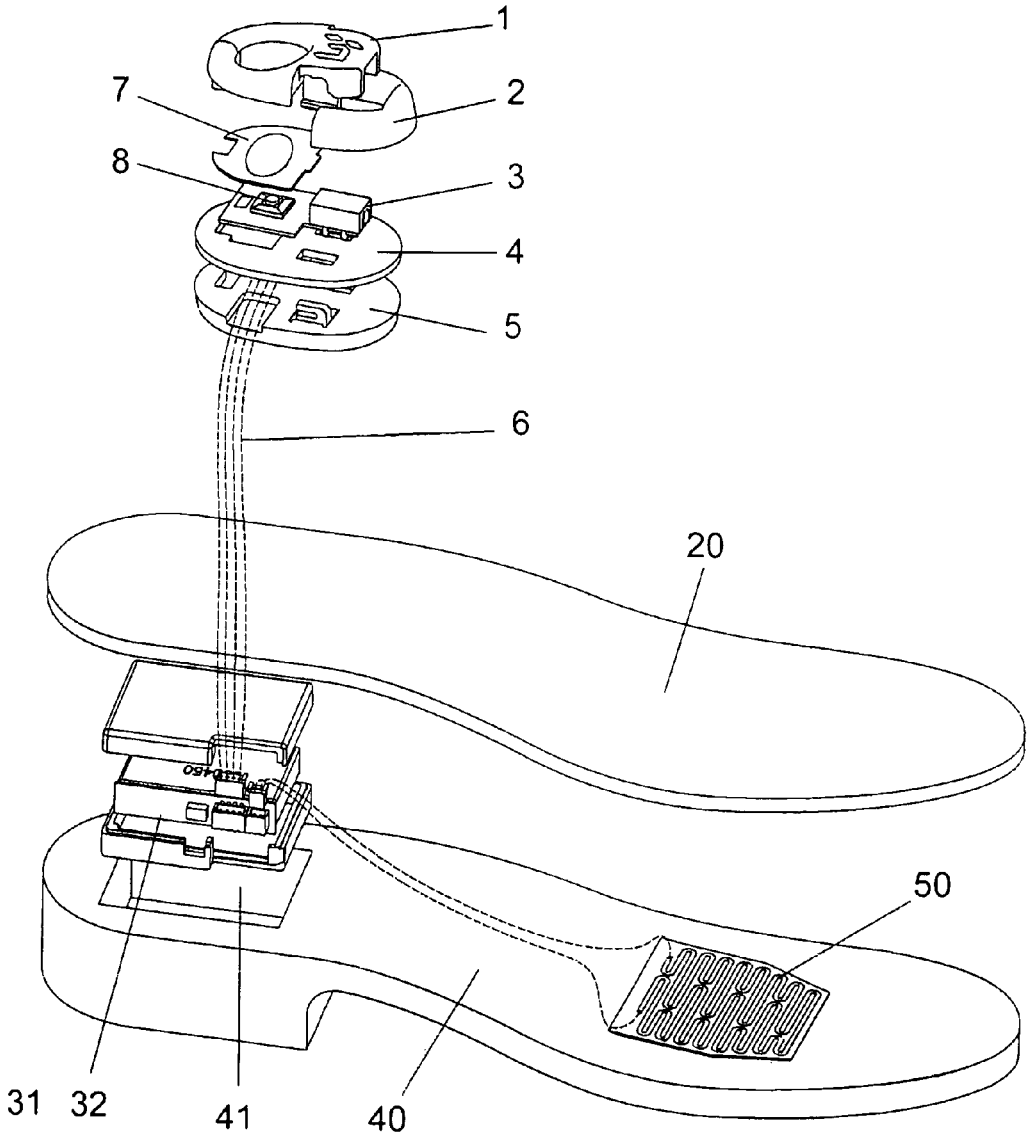
FIG. 1 is an exploded perspective view of footwear according to a preferred embodiment of the present invention.
Figure 2:
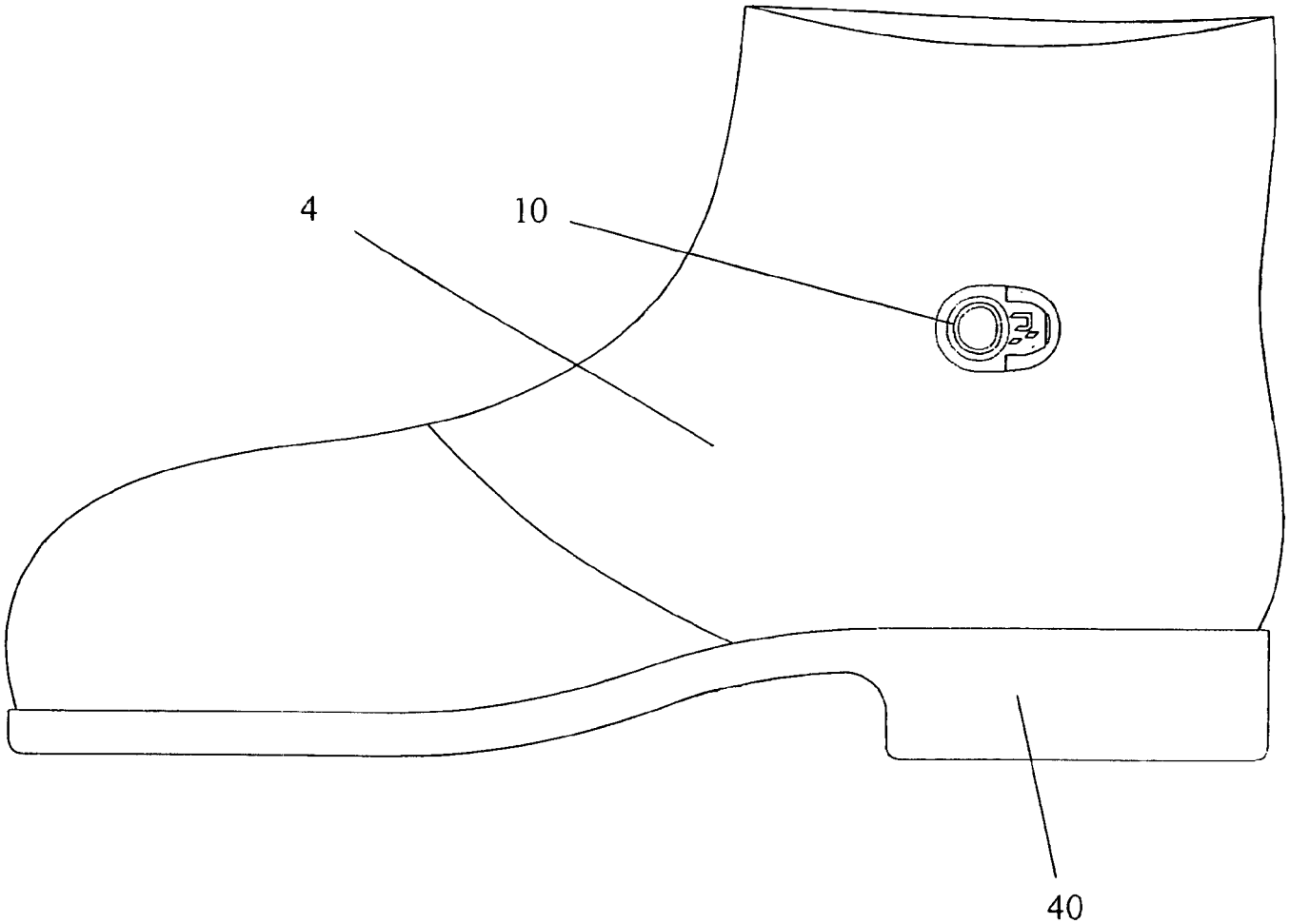
FIG. 2 is a perspective view of the footwear according to the above preferred embodiment of the present invention.

Referring to FIG. 1 to FIG. 2 of the drawings, a kind of footwear according to a preferred embodiment of the present invention is illustrated, in which the footwear, such as a shoe, comprises a footwear sole comprising an outsole 40, a footwear vamp 4, a heating arrangement comprising a rechargeable battery 31 received in the footwear sole, a control circuitry 32, a heater element 50, a switch 10 and a recharging inlet 3, wherein the heater element 50 is electrically connected to a thermistor in series.

Figure 3:
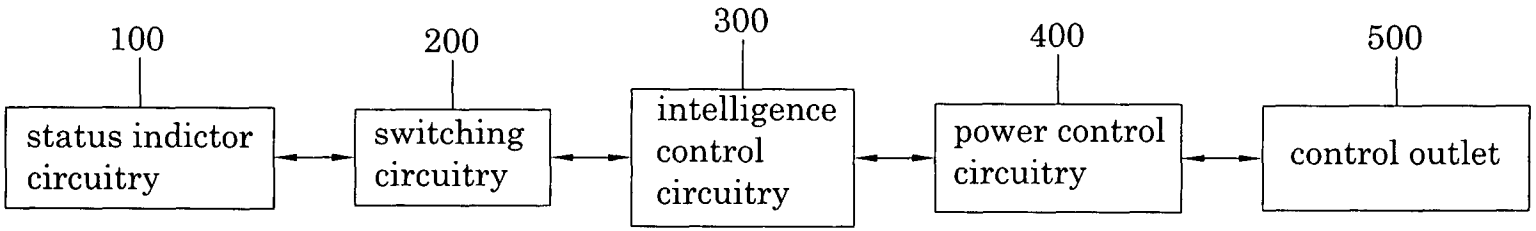
FIG. 3 is a schematic diagram of the heating arrangement of the footwear according to the above preferred embodiment of the present invention.
Figure 4:
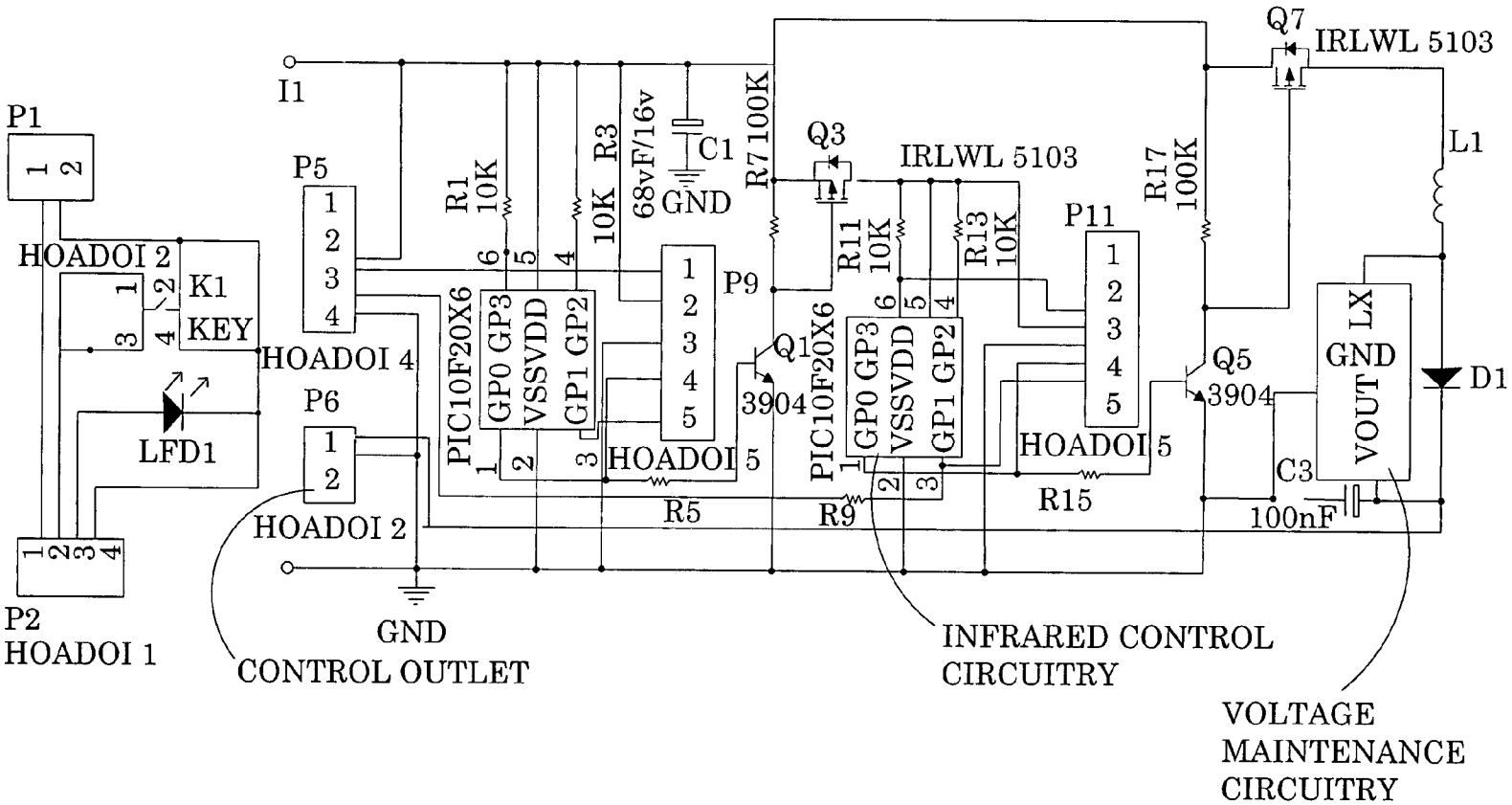
FIG. 4 is a circuit diagram of the heating arrangement of the footwear according to the above preferred embodiment of the present invention.

Referring to FIG. 3 and FIG. 4 in the drawings, the control circuitry 32 comprises a status indictor circuitry 100, a switching circuitry 200, an intelligence control circuitry 300, a power control circuitry 400, a control outlet 500, wherein the power control circuitry 400 comprises a voltage maintenance circuitry. The status indicator circuitry 100 comprises a LED, wherein the status indicator circuitry 100 is electrically connected with the intelligence control circuitry 300 in such a manner that the diode is driven by the intelligence control circuitry 300 to generate a predetermined signal for indicating a work status of the footwear. For example, when the footwear sole is being kept at constant temperature, the LED is turned on to generate light of a predetermined color. On the other words, when the heater element 50 is heating up the footwear sole, the LED may generate a blinking light signal for indicating that the footwear sole is being heated up.

The thermistor is a type of resistor whose resistance varies according to temperature. When the temperature reaches a predetermined threshold, the thermistor will have a predetermined resistance which activates the intelligence control circuitry 300 which in turns control the activation of the heater element 50. In other words, when the temperature of the footwear sole reaches a predetermined temperature, the resistance of the thermistor will reach a predetermined threshold which signals the intelligence control circuitry 300 to deactivate heating of the footwear sole. On the other hand, when the temperature of the footwear sole falls below a predetermined temperature, the resistance of the thermistor will also reach another threshold which signal the intelligence control circuitry 300 to activate the heater element 50 to heat up the footwear sole.

The voltage maintenance circuitry is utilized for elevating the voltage supplied by the rechargeable battery 31 and keep the voltage and current supplied by the rechargeable battery 31 substantially constant, so as to maximum the efficiency of the heater element 50 and minimize the required heating time. Moreover, the intelligence control circuitry 300 is arranged to control supply of electricity by the rechargeable battery 31 so as to prolong the period over which the rechargeable battery 31 may supply energy to the heater element 50 on a single recharge of the rechargeable battery 31. In other words, the intelligence control circuitry 300 will timely cut off electricity supply when the temperature of the footwear sole reaches a predetermined threshold.

As shown in FIG. 1 of the drawings, the footwear sole further comprises an insole 20, wherein the heater element 50 is positioned underneath the insole 20. Alternatively, the heater element 50 can also be embedded within the footwear sole, which is the receiving cavity formed between the insole 20 and the outsole 40. Moreover, when the footwear does not have the insole 20, the heater element 50 can be positioned directly on top of the outsole 40.

The heater element 50 preferably comprises an infrared heating unit provided for generating heat in the form of infrared radiation in the vicinity of Yongquan acupuncture point of the wearer (The infrared heating unit comprises an infrared filament which comprises carbon or tungsten wire, or any other kinds of heating films). The intelligence control circuitry 300 comprises an infrared control circuitry arranged to activate generation of infrared radiation. Thus, the infrared radiation generated by the heater element 50 will stimulate the Yongquan acupuncture point of the wearer and perform certain therapeutic purposes.

In order to prevent the recharging inlet 3 from being damaging or blocked by dirt, dusts etc., it is incorporated on the switch 10 and is located on the vamp 4 at a position in the vicinity of the vamp's opening. However, the switch 10 and the recharging inlet 3 may also be provided on other positions on the vamp 4. Furthermore, the switch 10 and the recharging inlet 3 may also be separately provided on the vamp 4 depending on manufacturing circumstances.

Referring to FIG. 1 of the drawings, the switch 10 comprises a back panel 5, a front panel 1 operatively coupled with the back panel 5, and a switch member 8 provided on the front panel 1, wherein the recharging inlet 3 is provided on the front panel 1 next to the switch member 8. The front panel 1 and the back panel 5 are alignedly attached on an outer side and an inner side of the vamp 4 respectively, wherein a user is able to directly access the switch member 8 and the recharging inlet 3 from an exterior of the footwear. The switch 10 further comprises a protective cover 2 movably mounted on the front panel 1 to normally cover the recharging inlet 3 so as to normally protect the recharging inlet 3 from being exposed to dirt or dusts etc. Moreover, the switch 10 further comprises a protective member 7 supported by the front panel 1 and aligned with the switch member 8 for protecting the switch member 8. The switch 10 and the recharging inlet 3 are electrically connected to the control circuitry 32 through electrical wires.

As an alternative of the present invention, either one or both of the protective cover 2 and the protective member 7 can be omitted and this omission will be affect the spirit of the present invention.

What is claimed is:

1. A footwear, comprising a footwear sole, a footwear vamp provided on top of said footwear sole, and a heating arrangement, wherein said heating arrangement comprises a rechargeable battery, a control circuitry, a heater element, a heater switch, and a recharging inlet, wherein said control circuitry comprises a switching circuitry and a status indicator circuitry which is electrically connected with said switching circuitry, a control outlet, an intelligence control circuitry which is electrically connected with said switching circuitry, a thermistor, and a power control circuitry which is electrically connected with said control outlet, wherein said power control circuitry comprises a voltage maintenance circuitry, wherein said intelligence control circuitry is electrically connected with said thermistor, wherein said heater element is electrically connected with said control circuitry, and is controlled by said control circuitry to selectively generate heat for maintaining a predetermined temperature at said footwear sole.

2. The footwear, as recited in claim 1, wherein said heater element comprises an infrared heating unit provided for generating heat by infrared radiation in a vicinity of Yongquan acupuncture point of a wearer, wherein said intelligence control circuitry comprises an infrared control circuitry arranged to activate generation of said infrared radiation.

3. The footwear, as recited in claim 2, wherein said infrared heating unit comprises an infrared filament which comprises carbon or tungsten wire, or any other kinds of heating films.

4. The footwear, as recited in claim 1, wherein said footwear sole comprises an insole, wherein said heater element is positioned underneath said insole.

5. The footwear, as recited in any one of claims 1-4, wherein said switch and said recharging inlet are provided on said footwear vamp.

6. The footwear, as recited in claim 5, wherein said switch and said recharging inlet are provided on said footwear vamp in a vicinity of vamp opening of said footwear vamp.

7. The footwear, as recited in claim 5, wherein said switch comprises a back panel, a front panel operatively coupled with said back panel, and a switch member provided on said front panel, wherein said recharging inlet is provided on said front panel next to said switch member, wherein said front panel and said back panel are alignedly attached on an outer side and an inner side of said footwear vamp respectively, wherein a user is able to directly access said switch member and said recharging inlet from an exterior of said footwear.

8. The footwear, as recited in claim 7, wherein said switch further comprises a protective cover movably mounted on said front panel to normally cover said recharging inlet so as to normally protect said recharging inlet from being exposed to dirt.

9. The footwear, as recited in claim 7, wherein said switch further comprises a protective member supported by said front panel and aligned with said switch member for protecting said switch member.

* * * * *